US005119106A

United States Patent [19]

Murakami

[11] Patent Number: 5,119,106

[45] Date of Patent: Jun. 2, 1992

[54] GLASS WINDOW ANTENNA FOR A MOTOR VEHICLE

[75] Inventor: Harunori Murakami, Machida, Japan

[73] Assignee: Nippon Sheet Glass Co., Ltd., Osaka, Japan

[21] Appl. No.: 772,608

[22] Filed: Oct. 8, 1991

Related U.S. Application Data

[63] Continuation of Ser. No. 581,680, Sep. 13, 1990, abandoned.

[30] Foreign Application Priority Data

Sep. 14, 1989 [JP] Japan ..... 1-238576

[51] Int. Cl.[5] ..... H01Q 1/32

[52] U.S. Cl. ..... 343/713; 343/704

[58] Field of Search ..... 343/704, 713, 711, 712; 219/203

[56] References Cited

U.S. PATENT DOCUMENTS

| | | | |
|---|---|---|---|
| 3,484,583 | 12/1969 | Shaw, Jr. | 343/704 |
| 3,766,563 | 10/1973 | Sauer et al. | 343/713 |
| 3,928,748 | 12/1975 | Sauer et al. | 343/704 |
| 4,608,570 | 8/1986 | Inaba et al. | 343/704 |
| 4,768,037 | 8/1988 | Inaba et al. | 343/713 |
| 4,849,766 | 7/1989 | Inaba et al. | 343/713 |

FOREIGN PATENT DOCUMENTS

| | | |
|---|---|---|
| 58-70643 | 4/1983 | Japan . |
| 61-30102 | 2/1986 | Japan . |
| 61-73403 | 4/1986 | Japan . |
| 61-203702 | 9/1986 | Japan . |
| 61-175010 | 10/1986 | Japan . |
| 62-201508 | 12/1987 | Japan . |
| 63-133707 | 9/1988 | Japan . |
| 63-269625 | 11/1988 | Japan . |
| 63-62136 | 12/1988 | Japan . |

*Primary Examiner*—Michael C. Wimer
*Assistant Examiner*—Hoanganh Le
*Attorney, Agent, or Firm*—Woodcock Washburn Kurtz Mackiewicz & Norris

[57] ABSTRACT

A first antenna conductor is provided onto a margin area of a group of defogging heater wires on a surface of a laminated window glass. A second antenna conductor is provided into an intermediate layer of the laminated glass. The former is tuned to receive waves in lower reception band and the latter is assigned to higher reception band with its conductor arranged to cross the heater wires. The first and second antenna conductors are coupled to obtain a good bandwidth characteristic even in relatively narrow space for conductors.

8 Claims, 4 Drawing Sheets

GLASS WINDOW ANTENNA FOR A MOTOR VEHICLE

This is a continuation of application Ser. No. 581,680, filed Sept. 13, 1990, now abandoned.

BACKGROUND OF THE INVENTION

1. Field of the Invention

This invention relates to a glass antenna for a motor vehicle, more particularly, to a glass window antenna which applies reception power to a receiver in a diversity reception system.

2. Description of the Prior Art

Reception condition varies in accordance with movement of reception point when an FM or TV broadcast wave is received by a traveling motor vehicle. A space diversity reception system using a plurality of antenna elements is employed to prevent quality of radio voice or TV picture from being degraded due to the variation of reception field. It is known to constitute these antenna elements for diversity reception with glass window antennas formed of conductors printed on a window glass of the motor vehicle (refer to, for example, Japanese patent application laid-open No. 203702/1986).

The glass window antenna is usually arranged on a rear glass window due to convenience to keep field of view of front windshield as well as problem of wiring between the antenna and a receiver A space to arrange the antenna conductor is however limited to upper or lower blank portion outside the middle area where defogging heater wires are attached with printing. Many antenna conductors can not be provided on a glass window having small blank areas. Especially, a small-sized automobile has an upright rear window with less blank area to arrange necessary antenna conductors thereon. Moreover, when many antenna conductors are arranged in the blank portion, they must have simple configuration with few constitutional elements. It restricts tuning factors of reception directivity and bandwidth.

Accordingly, it is an object of this invention to arrange antenna conductors having high efficiency for diversity reception on a limited area of glass window.

It is another object of this invention to provide arrangements of antenna conductors which can be incorporated with a space and frequency diversity reception system.

A window glass antenna for a motor vehicle according to this invention comprises a group of heater wires provided in a defogging area on the inside surface of a laminated window glass consisting of an inner glass and an outer glass; a first antenna conductor arranged out of said defogging area on the inside surface of the inner glass; a second antenna conductor inserted into an intermediate layer of the laminated glass and extending to cross the heater wires; and a coupling member to couple said first and second antenna conductors for constituting a single synthesized antenna; the first antenna conductor being assigned to a lower reception band and said second antenna conductor being assigned to an upper reception band.

The first antenna conductor shows sufficient gain with relatively simple conductor pattern since it is limited to reception of lower reception band, though conductors are hard to be patterned into a complex form for tuning on a narrow blank area. The second antenna conductor is insulated from hearer wires through a glass so that conductor can be a vertical element crossing the heater wires. A vertical element amounted on a motor vehicle can be easily tuned in higher frequency band.

The synthesized antenna consisting of the first and second antenna conductors coupled with each other has good reception characteristics over a wide frequency range. An antenna system which effectively uses a narrow space on the window glass is obtained.

The above, and other, objects, features and advantages of the present invention, will become readily apparent from the following detailed description thereof which is to be read in connection with the accompanying drawings.

DETAILED DESCRIPTION OF A PREFERRED EMBODIMENT

Figure 1:
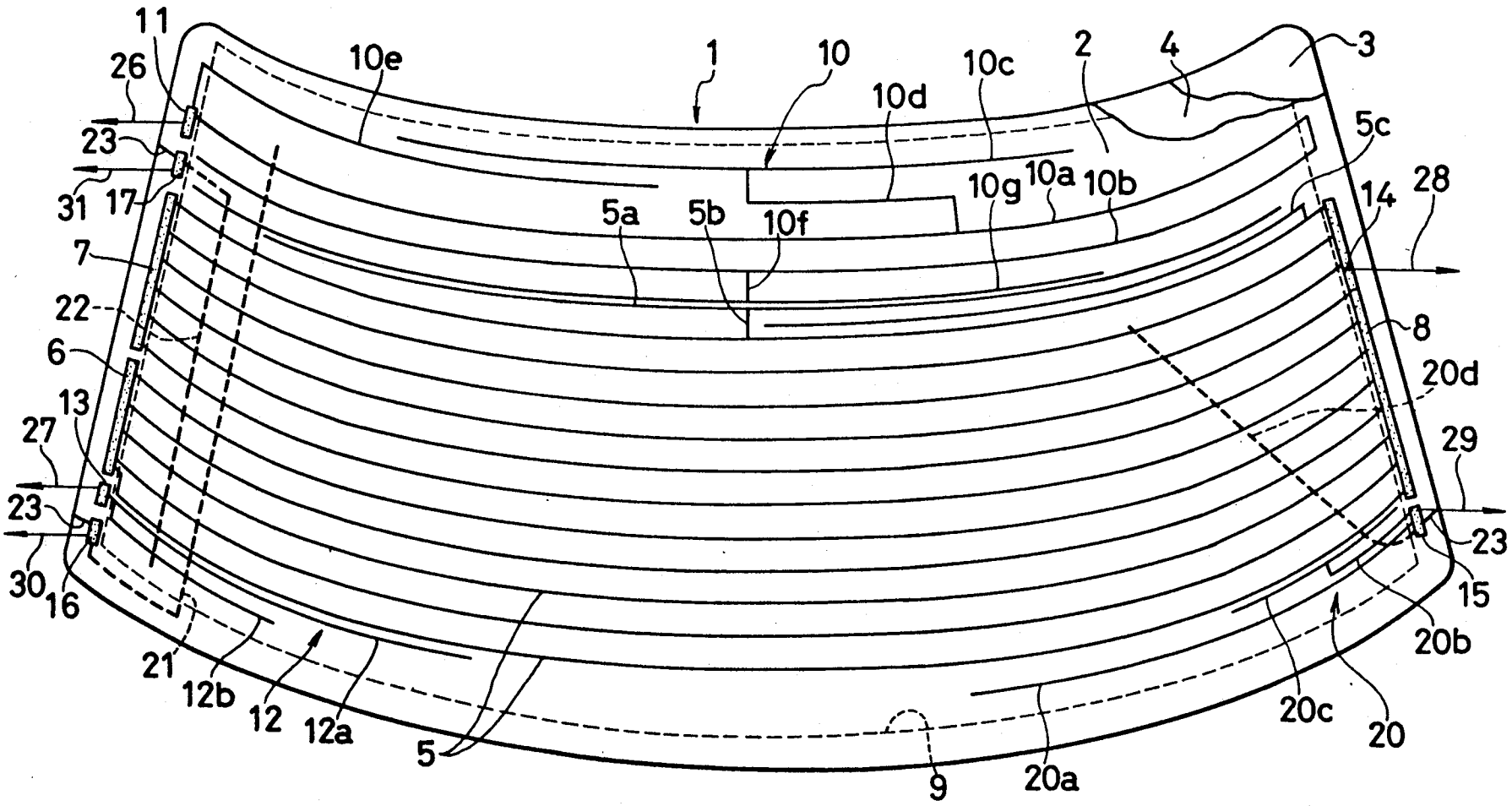
FIG. 1 is a front view of a rear glass window showing one embodiment according to this invention.

FIG. 1 is a front view of a rear window glass showing an embodiment of glass window antenna of a motor vehicle according to this invention. The rear glass window 1 is formed of a laminated glass consisting of an inner glass 2 and an outer glass 3 which are put together with an interlayer 4 formed of a transparent synthetic resin film intervening therebetween.

Figure 2:
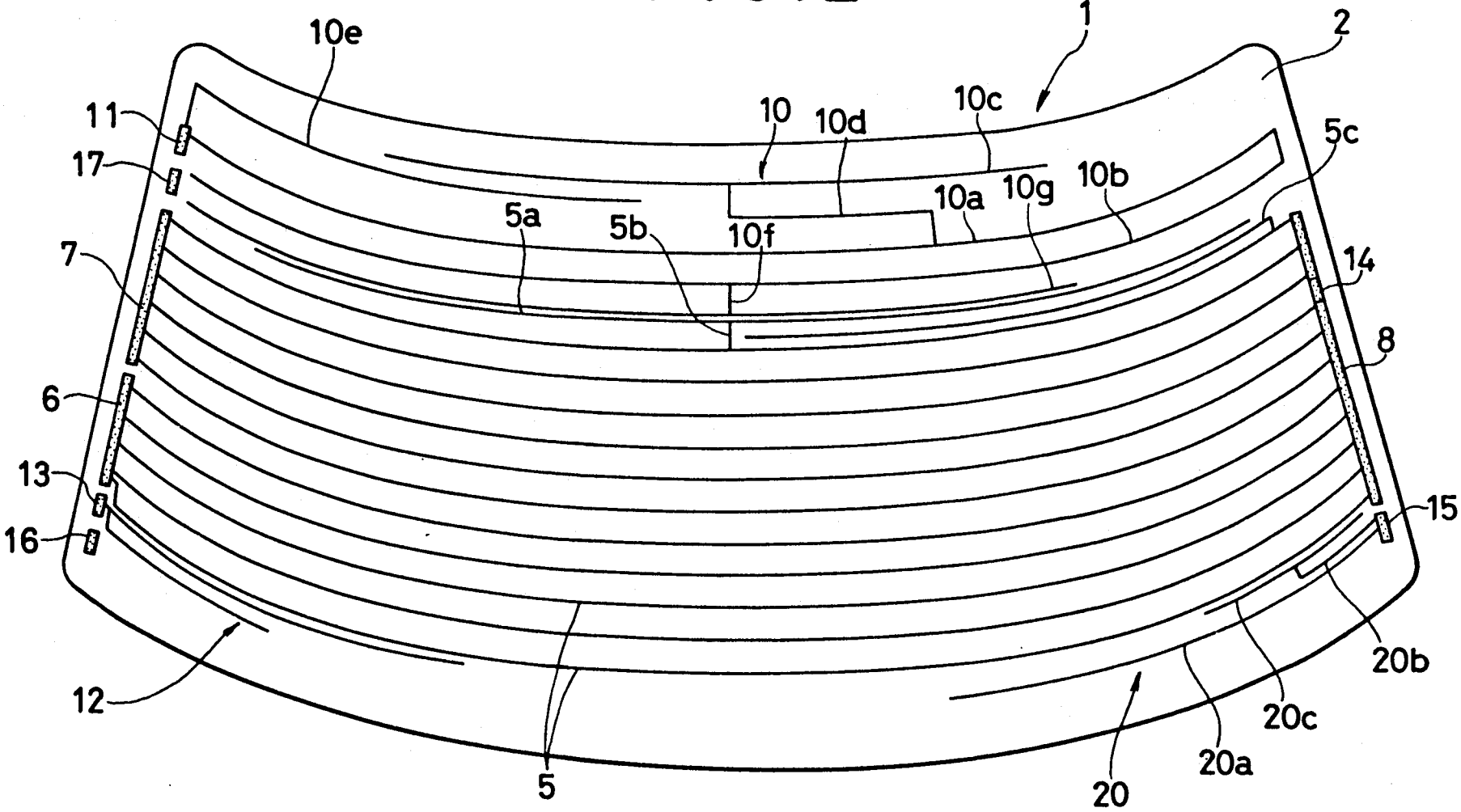
FIG. 2 is a front view of an inner glass having conductors arranged inside thereof.

A lot of heater wires 5 are arranged in a defogging area located in the central portion of the rear glass window 1. The heater wires 5 are supplied with power to remove fog on the glass surface to bus bars 6 and 7 at one end of the heater wires 5 through a return path via a bus bar 8 at another end. These bus bars 6, 7 and 8 and the heater wires 5 are formed on the inner glass 2 by printing silver past or the like on the inner surface thereof and baking thereafter, as shown in FIG. 2 illustrating a front view of the inner glass.

Antenna conductors are arranged on the same surface on which the heater wires are attached, that is, inside the inner glass 2, in upper and lower blank areas outside the defogging area. The antenna conductors are formed by printing conductive past. On the relatively large upper blank area, a main antenna 10 is arranged to receive AM/FM broadcast waves.

The main antenna 10 comprises horizontal elements 10*a* and 10*b* extending horizontally from a feed terminal located at left side portion of the glass and then folded to turn at right side portion, a horizontal element 10*c* conturn nected through a connecting element 10*d* to a tuning point located with shifted from the center of the element 10*a*, a horizontal element 10*e* shaped into letter-L and extending from the feed terminal 11 closely along the element 10*c*, a horizontal element 10*g* connected to the center of the element 10*b* through a connecting element 10*f*. A horizontal element 5*a* is arranged in parallel, close to the element 10*g*. The center of the element 5*a* is connected to the center of the uppermost heater wire 5 through a connecting element 5*b* so that induced wave (mainly AM wave) on the heater wires 5 is transferred to the AM/FM main antenna 10.

An FM subantenna 12 consisting of two parallel horizontal element 12*a* and 12*b* in length of about 400 mm and 200 mm is provided on the left side of the lower blank area. Reception power induced on the subantenna 12 is derived from an FM feed terminal 13 located under the bus bar 13.

Reception outputs at the feed terminals 11 and 13 of the main antenna 10 and subantenna 12 are fed to an FM diversity receiver through feeder cables 26 and 27. AM reception output of the main antenna 10 is fed to an AM receiver from the feed terminal 11 through a cable 26.

A diversity reception is adapted to receive TV broadcast wave. The first to fourth TV feed terminals 14–17 is provided inside the inner glass 2 to feed TV reception power. A masking 9 is provided along edge of the window glass 1 to have a width sufficient for concealing the bus bars 6, 7 and 8 and the feed terminals 11, 13 14–17 so as not to be seen from the outside of the motor vehicle.

The first TV feed terminal 14 is provided on the bus bar 8 to feed TV reception signal induced on the heater wires 5. An auxiliary element 5*c* is extended from an end portion of the uppermost heater wire 5 to compensate for reception characteristics of the heater wires 5 which is utilized as the first TV antenna.

The second TV antenna 20 is coupled to the second feed terminal 15 located under the bus bar 8. The second TV antenna 20 comprises a horizontal element 20*a* printed inside the inner glass, and a horizontal element 20*c* connected to the second feed terminal 15 to extend closely parallel with the lowermost heater wires 5. These elements 20*a* and 20*c* are respectively 500 mm and 200 mm in length and are tuned in lower band of TV broadcast wave.

Figure 3:
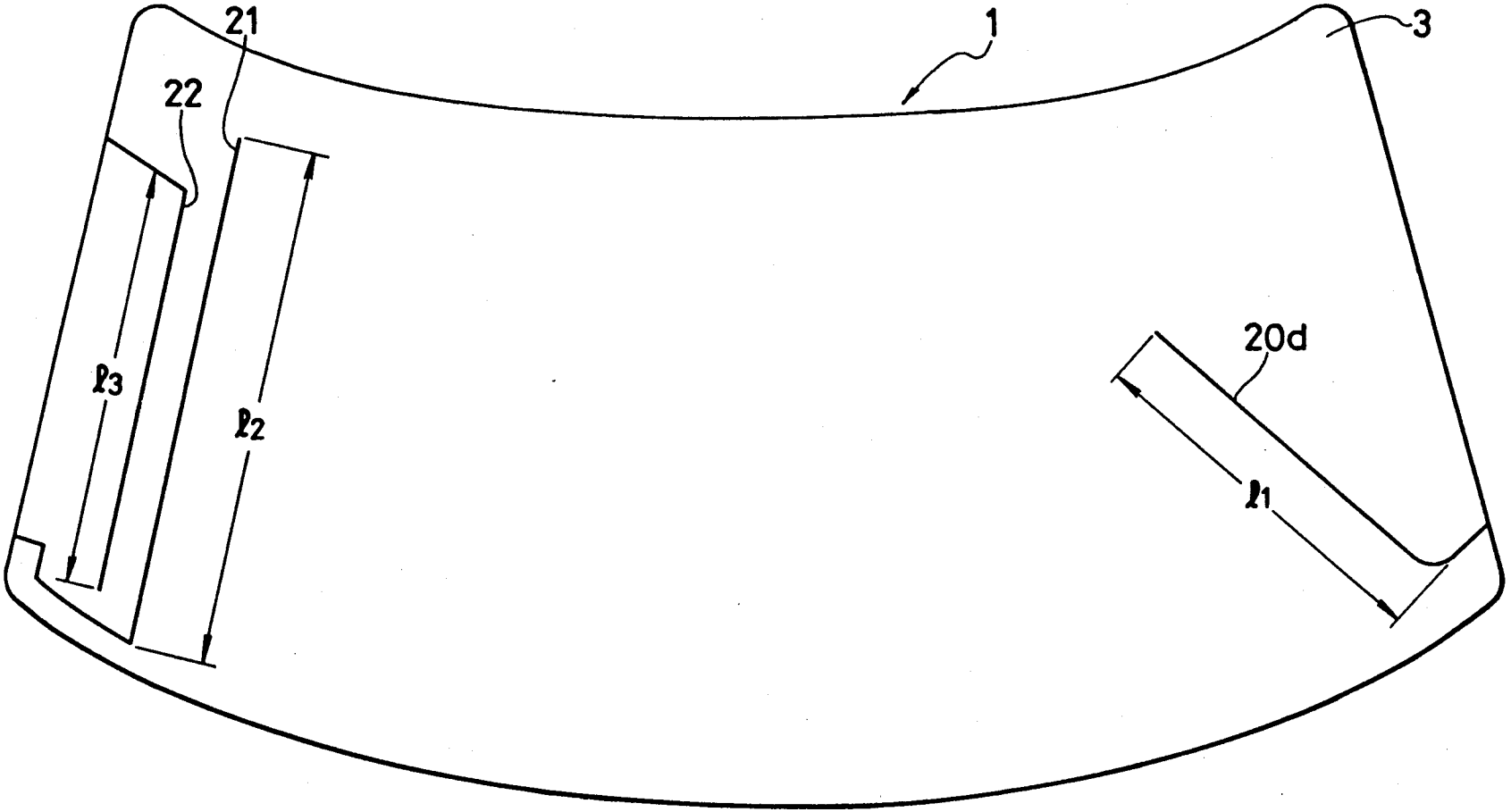
FIG. 3 is a front view of an outer glass showing wire antennas arranged inside thereof.

The second TV antenna 20 further comprises a wire antenna element 20*d* arranged to cross the heater wires 5 so as to have a vertical component. The wire antenna element 20*d* is formed of a metal wire having a diameter of about 0.13 mm which is provided inside the outer glass 3 so as to be put between the outer glass 3 and the interlayer 4, as shown in FIG. 3 illustrating a front view of the outer glass 3. The wire element 20*d* is therefore insulated from the heater wires 5 with the inner glass 2 and the interlayer 4 as shown in a cross-sectional view of FIG. 4. The wire antenna element 20*d* is about 300 mm in length to have a vertical element which effectively receives a higher band of TV broadcast wave. As there is less capacitive coupling between the wire antenna element 20*d* and the heater wires 5, the wire antenna has less degradation of reception characteristic in a higher band.

Figure 4:
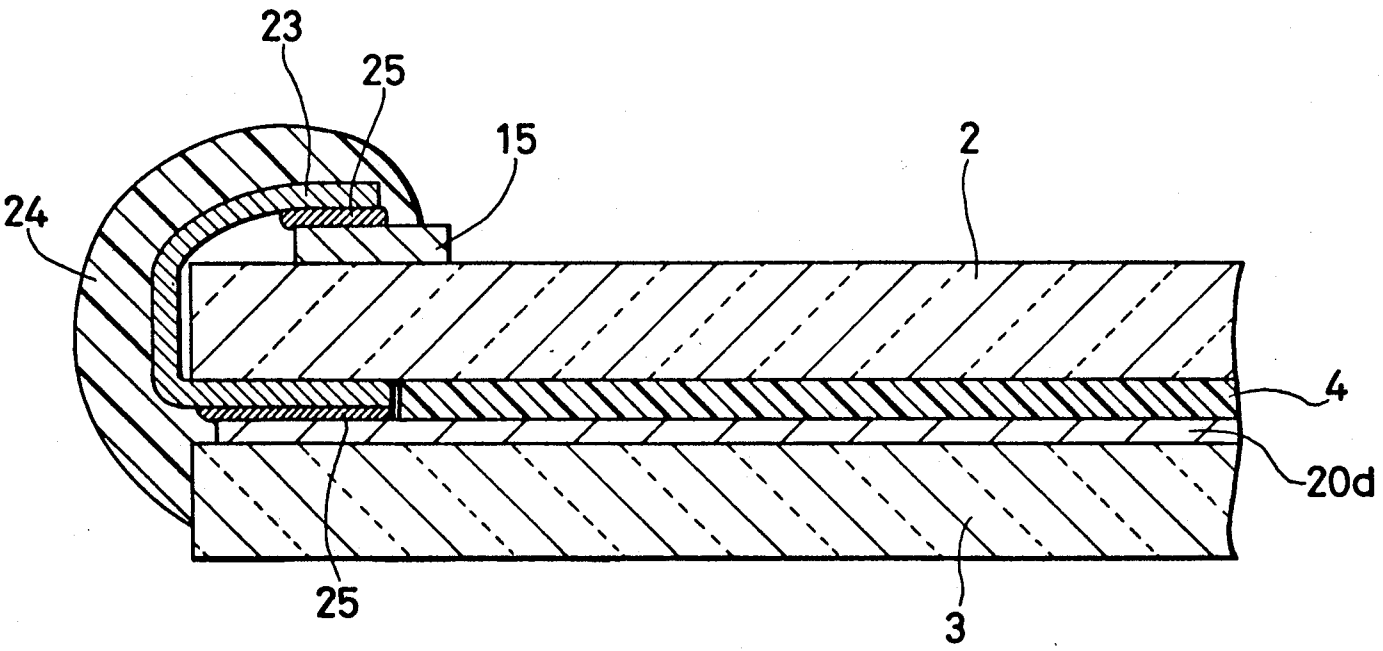
FIG. 4 is a cross-sectional view showing connecting feature of a feeding portion.

As shown in a cross-sectional view of FIG. 4, the wire antenna element 20*d* in the intermediate layer is coupled to the feed terminal 15 arranged inside the inner glass 2 through a copper thin plate 23 fixed by solder 25. A wide-band synthesized reception signal consisting of a low band component and a high band component is obtained at the feed terminal 15 respectively from the horizontal elements 20*a* and 20*c* and the wire antenna element 20*d*. The coupling portion by the copper thin plate 23 is covered with a resin seal 24.

Two long and short wire antenna elements 21 and 22 are inserted inside the outer glass 3 to extend vertically along left side thereof. The long wire antenna element 21 is utilized as the third TV antenna which has a length $l_2$=600 mm and is tuned in lower band (1–3 channels) of VHF-TV broadcast wave.

The short wire antenna element 22 is utilized as the fourth TV antenna which has a length $l_3$=400 mm and is tuned in higher band (4–12 channels) of VHF-TV broadcast wave.

The lower end of the wire antenna element 21 and the upper end of the wire antenna element 22 are respectively extended to a side edge of the outer glass 3 and then connected to the third and fourth feed terminals 16 and 17 located inside the inner glass 2 through the same connecting constitution as that shown in FIG. 4.

The TV reception signals obtained at the first to fourth feed terminals 14–17 are supplied to a TV tuner having a diversity reception system.

In the above-mentioned embodiment, the wire antenna elements 20*d*, 21 and 22 may be formed of printed conductors.

According to the invention, the first antenna conductor 20*a* and 20*c* arranged in the blank area outside the area of the heater wires 5 is restricted to exclusive use in a lower reception band so that it can be tuned to have a high gain even in a narrow space on the glass. A sufficient reception gain is obtained over a wide range with a synthesized output generated by the first antenna conductor and the second antenna conductor 20*d* which is tuned for exclusive use in higher band. The second antenna conductor 20*d* can be a vertical element crossing the heater wires 5 so that it can be easily tuned for use in higher band. Especially, the second antenna conductor 20*d* shows a good reception characteristic in a high frequency range as it has less capacitive coupling with the heater wires.

A diversity reception is performed with signals consisting of the reception outputs of antenna conductors 21 and 22, the reception output of the heater wires 5 and the reception output of the synthesized antenna. Good reception characteristics are obtained by using several antenna elements even in a case where areas for the antenna conductors on a window glass is restricted.

What is claimed is:

1. A glass window antenna for a motor vehicle comprising:

a group of heater wires provided in a defogging area on the inside surface of a laminated window glass consisting of an inner glass and an outer glass;

a first antenna conductor arranged out of said defogging area on the inside surface of said inner glass and assigned to a lower reception band;

a second antenna conductor disposed on an intermediate layer between said inner glass and said outer glass of the laminated glass and extending to cross the heater wires and assigned to an upper reception band;

a coupling member to cuple said first and second antenna conductors for constituting a single synthesized antenna; and a third antenna conductor disposed on said intermediate layer between said inner glass and said outer glass of said laminated glass and extended to cross the heater wires in a lateral side area different from an area where said synthesized antenna is arranged, said third antenna conductor comprising two independent antenna conductors consisting of a single long conductor and a single short line conductor, each conductor of said independent antenna conductors being connected to a different feed terminal, an output of said third antenna conductor being derived for diversity reception together with the output of said synthesized antenna.

2. A glass window antenna according to claim 1, wherein a feed terminal of said synthesized antenna and a third feed terminal for said third antenna are formed on the inside surface of said inner glass.

3. A glass window antenna according to claim 1, wherein said first antenna conductor comprises a single horizontal conductor extending from said feed temrinal and a horizontal conductor extending close along the heater wires to collect induced reception power from said heater wires.

4. A glass window antenna according to claim 1, wherein feed terminals of said third antenna conductor are located respectively on the inside surface of upper and lower portions of said inner glass.

said long and short line conductors extending in opposite direction to each other to cross said heater wires and said line conductors being respectively connected to the correspondign feed terminals through connecting members.

5. A glass window antenna according to claim 1, further comprising a fourth antenna conductor employing said heater wires, reception outputs by said synthesized antenna, said third antenna conductor and said fourth antenna conductor being derived to a diversity reception system.

6. A glass window antenna according to claim 5, wherein said fourth antenna conductor comprises said heater wires and an auxiliary, horizontal antenna conductor formed on the inside surface of the inner glass and connected to said heater wires to extend from the side area of the laminated glass where said synthesized antenna is located.

7. A glass window antenna according to caim 1, wherein said first and second antenna conductors are assigned respectively to a lower band and an upper band of a TV broadcast band and said short and long line conductors are assigned respectively to a lower band and a upper band of the TV broadcast band.

8. A glass window antenna according to claim 7, further comprising an antenna conductor provided outside the defogging area on the inside surface of the inner glass of the laminated glass for reception of a radio broadcast wave.

* * * * *